United States Patent [19]

Takahashi

[11] 4,263,943

[45] Apr. 28, 1981

[54] APPARATUS FOR MANUFACTURING A SLIDE FASTENER STRINGER HAVING A WOVEN COILED COUPLING ELEMENT

[75] Inventor: Kihei Takahashi, Uozu, Japan

[73] Assignee: Yoshida Kogyo K. K., Tokyo, Japan

[21] Appl. No.: 83,822

[22] Filed: Oct. 11, 1979

[30] Foreign Application Priority Data

Oct. 24, 1978 [JP] Japan ..... 53-130813

[51] Int. Cl.[3] ..... D03D 1/00

[52] U.S. Cl. ..... 139/35

[58] Field of Search ..... 139/11 R, 35, 116, 384 B, 139/54; 24/205, 16 C; 29/766, 769

[56] References Cited

U.S. PATENT DOCUMENTS

| | | | |
|---|---|---|---|
| 3,880,199 | 4/1975 | Riha et al. | 139/54 |
| 3,982,566 | 9/1976 | Glindmeyer et al. | 139/35 |
| 4,174,736 | 11/1979 | Takahashi et al. | 139/384 B |
| 4,184,518 | 1/1980 | Yoshida et al. | 139/35 |

*Primary Examiner*—Henry Jaudon

*Attorney, Agent, or Firm*—Hill, Van Santen, Steadman, Chiara & Simpson

[57] ABSTRACT

An apparatus for manufacturing a slide fastener stringer having a woven stringer tape and a coiled coupling element woven therein, includes a needle loom for weaving the stringer tape of warp and weft threads, a mandrel for extending at an angle to the warp threads, and a rotor assembly to be located alongside of the warp threads for winding a monofilament around the mandrel in a circular path to form the coiled coupling element, which is then woven into the stringer tape by the weft thread. A means on the rotor assembly guides the monofilament to revolve in a substantially conical orbital path around the mandrel, which is eccentric with the circular path and is located closer to the warp threads than the rotor assembly is, so that the monofilament is kept under substantially uniform tension while revolving in the substantially conical orbital path.

10 Claims, 13 Drawing Figures

APPARATUS FOR MANUFACTURING A SLIDE FASTENER STRINGER HAVING A WOVEN COILED COUPLING ELEMENT

BACKGROUND OF THE INVENTION

1. Field of the Invention

The present invention relates to an apparatus for manufacturing a slide fastener stringer including a woven stringer tape and a coiled coupling element woven into the stringer tape along a longitudinal edge thereof.

2. Prior Art

Known apparatus for producing a slide fastener stringer of the type described above generally comprise a shuttleless loom such as a needle loom for weaving a stringer tape and a rotor assembly operatively associated with the loom for supplying a monofilament and a core thread, the rotor assembly including a mandrel for extending along a longitudinal edge of the tape being formed, and adjacent to the fell of the tape. The rotor assembly winds or coils the monofilament around the mandrel and the core thread fed therealong, thereby forming the coiled coupling element reinforced with the core thread as they are woven into the tape by being interlaced with weft threads inserted by filling carriers of the loom.

The rotor assembly comprises a housing, a wheel or rotor rotatable in the housing and having an axial off-center hole through which the monofilament passes, and a hollow axle around which the wheel is rotatable and thorugh which the core thread is supplied from a bobbin on the axle, the mandrel being fixed to the axle. Since during operation of the apparatus the wheel revolves so as to turn the monofilament in an orbital motion around the axle, the axle floats in the wheel and is held nonrotatable only by the mandrel that engages the coiled coupling element wound therearound and woven into the stringer tape. Therefore, the axle is liable to get jiggled and turned about its own axis due primarily to frictional engagement with the revolving wheel and to vibrations transmitted from the mandrel around which monofilament coiling action takes place. Such movements of the axle in turn amplify vibratory movements of the mandrel, which grow greater and greater as the wheel rotates at higher speeds. This condition has led to drawbacks in that the monofilament being coiled can be shaped irregularly and the weft threads being inserted tend to get loosened at the tape edge. Furthermore, the filling carriers which reciprocate across the mandrel to insert the weft threads may collide with the vibrating mandrel, whereby the mandrel can be bent or broken.

To solve such problems, there has been devised an apparatus for manufacturing a woven slide fastener stringer, as disclosed in U.S. Pat. No. 4,174,736, filed on Nov. 3, 1978, assigned to the present assignee, the apparatus having a mandrel that is held stationarily at all times with respect to the frame of the apparatus.

One problem with the conventional apparatus is that since the mandrel extends obliquely with respect to the warp threads for the stringer tape, the monofilament is subjected to varying tension as it moves toward and away from the warp threads while revolving around the mandrel. The monoflament under fluctuating tension tends to be wound into irregular coils with enlarged coupling heads displaced out of position, resulting in poor quality and malfunctioning of slide fasteners.

When a relatively large bobbin of core thread is to be used, the rotor assembly has to be located away from the warp threads so that the bobbin will not interfere with the warp threads. With such an arrangement, however, the monofilament as it moves around the mandrel forms a larger angle with respect to the warp threads than it would otherwise do with the results that the monofilament will be supplied under more varying tension and the legs of formed coupling elements will be inclined with respect to the warp threads.

SUMMARY OF THE INVENTION

According to the present invention, a tension equalizing means is mounted on a monofilament winding means and is responsive to the operation of the latter for guiding a monofilament to revolve in a substantially conical orbital path around a mandrel, which is eccentric with a circular path that the monofilament is caused to follow by the monofilament winding means and which is located closer to warp threads to be woven into the stringer tape than the monofilament winding means is. With such an arrangement, the length of the monofilament between the monofilament winding means and a portion of the mandrel around which the monofilament is coiled is substantially constant at all times, whereby the monofilament is kept under substantially uniform tension while revolving in the substantially conical orbital path.

An object of the present invention is to provide an apparatus for manufacturing a woven slide fastener stringer, the apparatus having means for equalizing the tension of the monofilament while revolving around the mandrel.

Another object of the present invention is to provide an apparatus for manufacturing a woven slide fastener stringer having a coiled coupling element shaped to a predetermined nicety.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
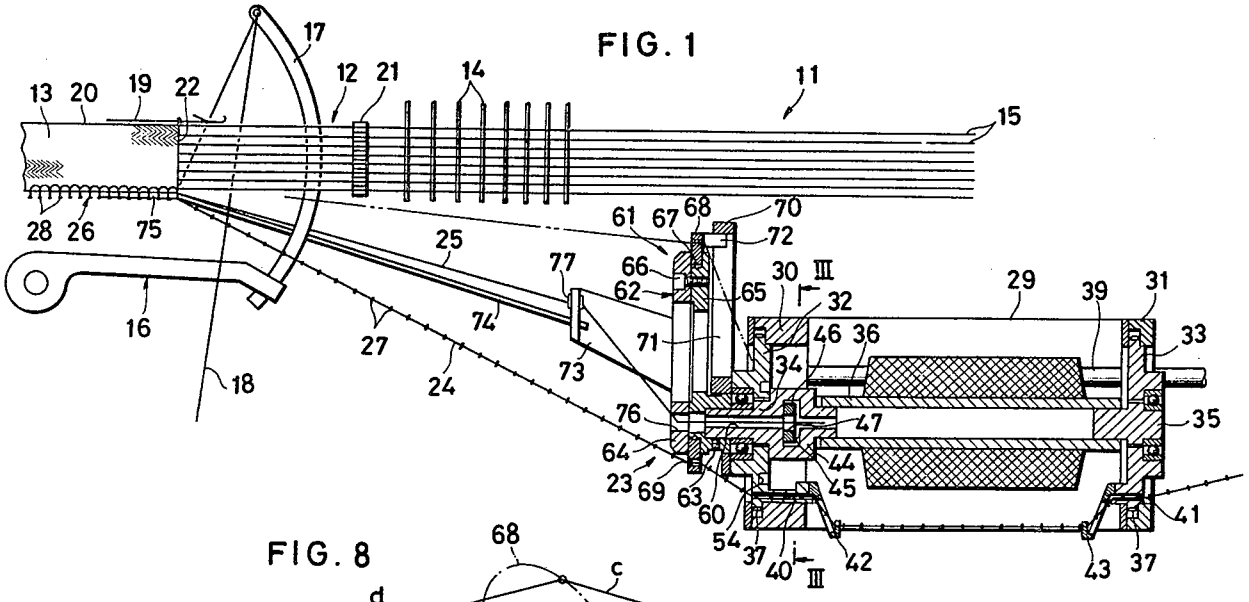
FIG. 1 is a plan view partly in cross section of a weaving apparatus having a tension equalizer constructed in accordance with the present invention.

The principles of the present invention are particularly useful when embodied in an apparatus such as shown in FIG. 1, generally indicated by the numeral 11.

The apparatus 11 includes a needle loom 12 of a known construction for producing a narrow, continuous slide fastener stringer tape 13, the loom 12 essentially comprising a plurality of harnesses 14 for forming sheds by raising and lowering warp threads 15 selectively, a weft inserter 16 having a filling carrier 17 for inserting a weft thread 18 through the warp sheds, a latch needle 19 reciprocable in warp direction alongside of one longitudinal edge of the tape 13 for catching and knitting the weft thread 18 carried by the filling carrier 17 so as to form a tape selvage 20 along said longitudinal tape edge, and a reed 21 for beating the weft thread 18 into the fell 22 of the tape 13.

The apparatus 11 of FIG. 1 further includes a coiling rotor assembly 23 disposed alongside of the warp shed for supplying a monofilament 24 and a core thread 25 and for winding or coiling the monofilament 24 in a conical orbital path so as to shape the monofilament 24 into a helically coiled coupling element 26 to be disposed along the tape edge remote from the selvaged edge 20. The monofilament 24 is made of plastic material and has a plurality of widened, flattened portions 27 spaced at predetermined intervals therealong, such portions 27 being formed as by stamping. The widened, flattened portions 27 permit the monofilament 24 to be bent or folded over easily at such portions when the monofilament 24 is being coiled, and alternate widened, flattened portions 27 function as coupling heads 28 of the element 26.

The coiling rotor assembly 23 generally comprises a horizontal base 29, a pair of first and second housings 30,31 spaced from each other and extending upwardly from the base 29, a pair of first and second wheels 32,33 rotatably mounted in the first and second housings 30,31, respectively, and a pair of floating bushings 34,35, the wheels 32,33 being rotatably mounted around the bushing 34,35, respectively. The wheels 32,33 have peripheral teeth 37 which mesh in driven relation with gears 38 (only one shown in FIG. 3) disposed respectively in the housing 30,31 and mounted on a drive shaft 39 that is connected to a suitable electric motor (not shown).

The wheels 32,33 have a pair of holes 40,41, respectively, that are aligned axially with one anoter and are located eccentrically of the bushing 34, and a pair of guides 42,43, respectively, that are positioned respectively adjacent to the holes 40,41.

Figure 3:
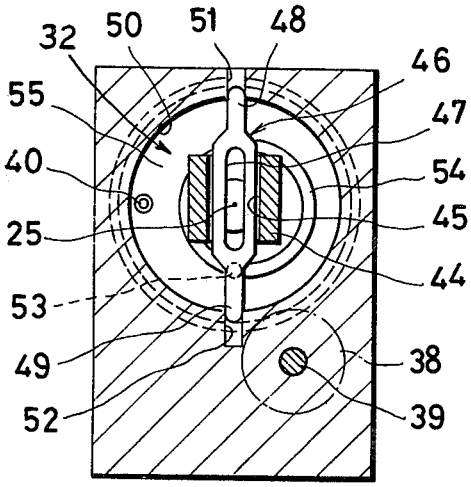
FIG. 3 is a cross-sectional view taken along line III—III of FIG. 1, showing a position of a pair of plungers for immovably holding a floating axle relatively to a housing.

The bushing 34 includes a casing 44 having a vertical slot 45 extending therethrough. As best illustrated in FIG. 3, a cam follower 46 is slidably disposed in the vertical slot 45 and has a vertically oblong hole 47 through which the core thread 25 passes. The cam follower 46 has a pair of upper and lower plungers 48,49 directed away from each other and movable along a diametrical path across the wheel 32 when the cam follower 46 reciprocates in the slot 45. The housing 30 has a circular opening 50 concentric with the wheel 32, and a pair of diametrically opposite, upper and lower recesses 51,52 opening to the circular opening 50 and located radially outwardly of the circular opening 50 and in the path of movement of the plungers 48,49 for receiving them, respectively. The cam follower 46 has a roller 53 disposed downwardly of the oblong hole 47 and received in a cam groove 54 disposed eccentrically in a face 55 of the wheel 32.

When the wheel 32 revolves, the guide 42 moves the monofilament in a circular orbit along the edge of the housing 30 which bounds the circular opening 50, such orbital path being intersected by the path of movement of the plungers 48,49. As the guide 42 moves in its orbit past a point that is angularly spaced 90 degrees apart from both the recesses 51,52 (FIG. 3), the cam follower 46 is substantially in the middle position of its stroke and the plungers 48,49 are disposed partly in the recesses 51,52, respectively, and engage the housing 30, so that the floating bushing 34 is held immovably with respect to the housing 30. Assuming that the wheel 32 rotates counterclockwise in FIG. 3, when the guide 42 approaches the lower recess 52, the cam follower 46 is caused to move upwardly, with the upper plunger 48 being inserted into the upper recess 51 and the lower plunger 49 being withdrawn out of the lower recess 52. Continued rotation of the wheel 32 introduces the upper plunger 48 fully in the upper recess 51 and retracts the lower plunger 49 out of the circular orbit of the axis of the hole 40, whereupon the guide 42 clears the retracted lower plunger 49. At this time, the floating bushing 34 is maintained stationarily with respect to the housing 30 by the upper plunger 48. As the wheel 32 continues revolving counterclockwise, the cam follower 46 is lowered thereby withdrawing the upper plunger 48 out of the upper recess 51 and inserting the lower plunger 49 into the lower recess 52. Thus, the guide 42 is allowed to move past the upper plunger 48 and to cross the path of movement of the cam follower 46, and at the same time, the lower plunger 49 keeps the floating bushing 34 immovable relatively to the bushing 30.

With such an arrangement, the floating bushing 34 is maintained stationarily with respect to the housing 30 by means of the upper plunger 48, the lower plunger 49, or both, engaging the housing 30 wherever the guide 42 is in its rotational path.

Figure 2:
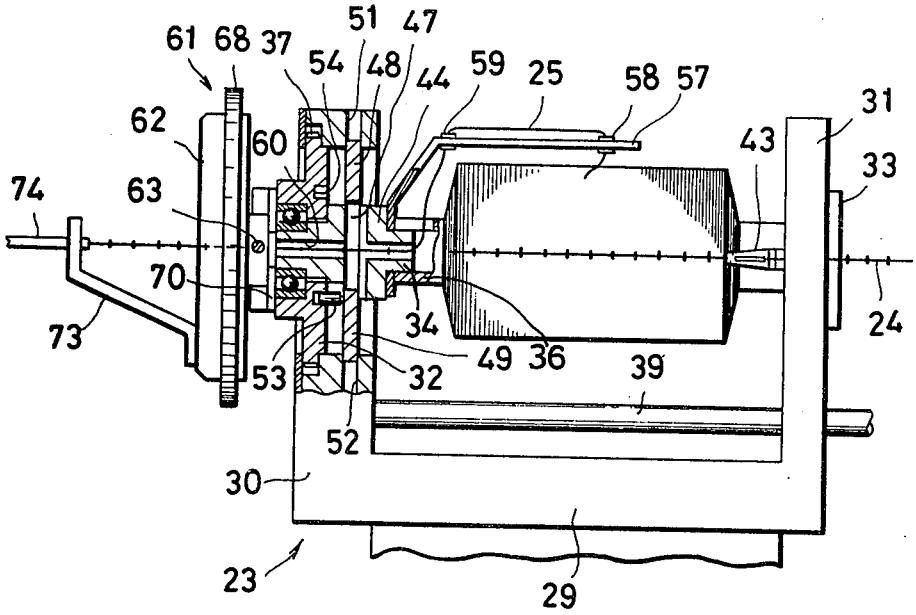
FIG. 2 is a front elevational view with parts in cross section of the apparatus shown in FIG. 1.

FIGS. 1 and 2 further illustrate a bobbin 36 for the core thread 25, supported rotatably on the bushings 34,35. A core thread guide arm 57 (FIG. 2) is secured to the bushing 34 and extends above the bobbin 36. The guide arm 57 has a pair of eyelets 58,59 through which the core thread 25 pays out of the bobbin 36. The core thread 25 as it is discharged passes through an axial hole 60 in the bushing 34 extending across the slot 45.

A monofilament tension equalizer 61 is mounted on the coiling rotor assembly 23. The monofilament tension equalizer 61 comprises a guide disk 62 fixed in eccentric relation to a projecting end of the floating bushing 34 by a setscrew 63. The guide disk 62 is composed of a pair of annular plates 64,65 fixed together by a screw 66. The annular plates 64,65 jointly define a peripheral circular guide groove 67 in which a guide ring 68 is rotatably disposed for rotation concentrically with respect to the annular plates 64,65, the guide ring 68 lying substantially parallel to the wheel 32. The guide ring 68 has an arcuate slot 69 (FIGS. 4 through 7) for the passage therethrough of the monofilament 24 as it issues out of the outlet hole 40 in the wheel 32.

An arm 70 is fixed to the wheel 32 for rotation therewith around the bushing 34, the arm 70 having a radial guide slot 71. The guide ring 68 has a pin 72 projecting axially into the guide slot 71 for slidable movement longitudinally therethrough. Thus the guide ring 68 is rotatable around the guide disk 62 in response to the revolution of the arm 70 with the wheel 32, with the pin 72 moving back and forth in the guide slot 71.

As shown in FIGS. 1 and 2, the annular plate 64 supports thereon a mandrel support 73 on which there is mounted a mandrel 74 extending at an angle to the warp threads 15 and to the axis of the floating bushings 34,35. The mandrel 74 includes a needle portion 75 that lies substantially parallel and is disposed closely to the edge of the stringer tape 13 being woven, the needle portion 75 extending beyond the fell 22 of the stringer tape 13. The monofilament 24 is coiled around the needle portion 75 of the mandrel 74 to form the coiled coupling element 26 as the monofilament 24 revolves around the mandrel 74.

The guide disk 62 has a hole 76 coaxial with the hole 60 in the floating bushing 34, and the mandrel support 73 has an eyelet 77. The core thread 25 as it pays out passes through the hole 60, the hole 76 and then the eyelet 77 for being fed along the mandrel 74 toward the needle portion 75 thereof, at which the monofilament 24 is wound around the needle portion 75 and the core thread 25.

Figure 8:
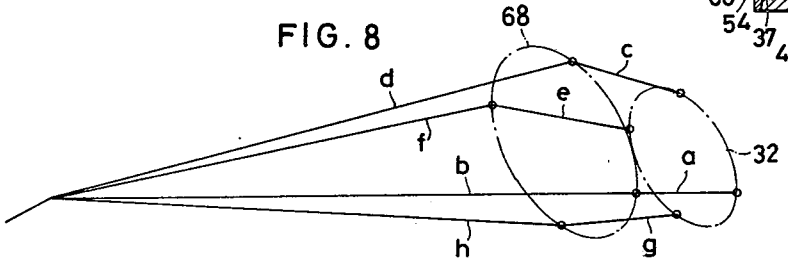
FIG. 8, appearing with FIG. 1, is a schematic perspective view of successive positions in a conical orbital path of a monofilament.
Figure 4:
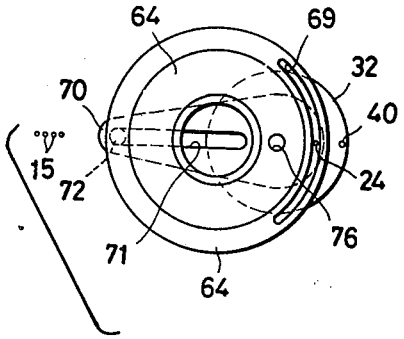
FIGS. 4 through 7 are views illustrating successive relative positions of a monofilament outlet hole and a guide disk in the tension equalizer.

When the wheel 32 and the guide ring 68 are in the position shown in FIG. 1, which corresponds to the position of FIG. 4, a portion of the monofilament 24 that extends between the outlet hole 40 in the wheel 32 and the needle portion 75 of the mandrel 74 is located farthest from the warp threads 15, and has a length equal to a+b (FIG. 8), where a equals the distance between the outlet hole 40 and a closest point in the arcuate slot 69, and b equals the distance between that point in the arcuate slot 69 and the needle portion 75 of the mandrel 74. At this time, the monofilament 24 is located in the center of the arcuate slot 69 (FIG. 4).

Figure 5:
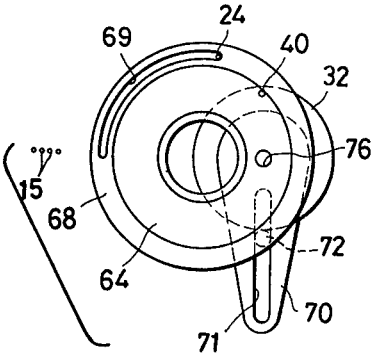

Upon counterclockwise angular movement of the wheel 32 through 90 degrees as shown in FIG. 5, the guide ring 68 is angularly moved through more than 90 degrees by the pin 72 guided for movement along an arcuate path by the guide slot 71. The monofilament 24 now is seated against one end of the arcuate slot 69 which is closer to the outlet hole 40. The length of a portion of the monofilament 24 extending between the outlet hole 40 and the needle portion 75 is the sum of c+d (FIG. 8), which is substantially equal to the sum of a+b. Such equalization of the length of the monofilament 24 even at different positions thereof in a substantially conical orbital path around the mandrel 74 is accomplished by the fact that although the distance d is smaller than the distance b, the distance c is larger than the distance a by the difference between the distances d and c.

Figure 6:
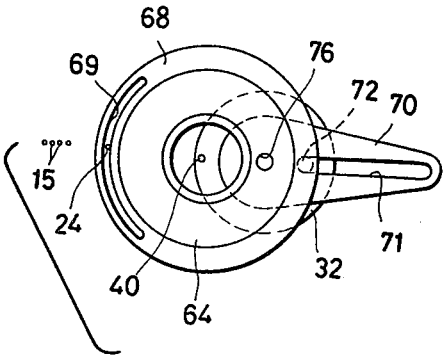

Similarly, continued 90-degree angular movement of the wheel 32 to the position of FIG. 6 causes the guide ring 68 to turn around the guide disk 62 to a position in which the arcuate slot 69 is positioned diametrically opposite to its initial position shown in FIG. 4 and in which the monofilament 24 is located centrally in the arcuate slot 69. The monofilament 24 now has a portion extending for the length of e+f (FIG. 8), which is still substantially equal to the length of a+b for the reason described above.

Figure 7:
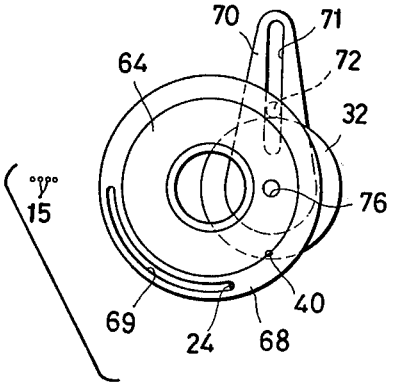

With the wheel 32 angularly moved counterclockwise through an additional 90 degrees as shown in FIG. 7, the guide ring 68 is turned through less than 90 degrees to the illustrated position, in which the monofilament 24 is seated against the other end of the arcuate slot 69 which is now closer to the outlet hole 40 in the wheel 32. The length of a portion of the monofilament 24 extending from the outlet hole 40 to the needle portion 75 is the same as the sum of g and h (FIG. 8), which is substantially the same as the composite length of a and b.

Accordingly, while the wheel 32 revolves to rotate the monofilament 24 in a circular path described by the outlet hole 40, the guide ring 68 enables the monofilament 24 to revolve in a substantially conical orbital path around the mandrel 74 in eccentric relation to said circular path, the conical orbital path being located closer to the warp threads 15 than the coiling rotor assembly 23. This arrangement is advantageous in that the coiling rotor assembly 23 can be located away from the warp threads 15 so as to accommodate a relatively large bobbin thereon, and at the same time the monofilament 24 can be rotated in a substantially conical orbital path close to the warp threads 15.

The length of a portion of the monofilament 24 extending between the outlet hole 40 in the wheel 32 and the needle portion 75 of the mandrel 74 is kept substantially constant at all times regardless of the positions the monofilament 24 takes while revolving in the conical orbital path around the mandrel 74. Therefore, the monofilament 24 is tensioned to a substantially constant degree during its movement toward and away from the warp threads 15 while rotating in the conical orbital path.

Figure 9:
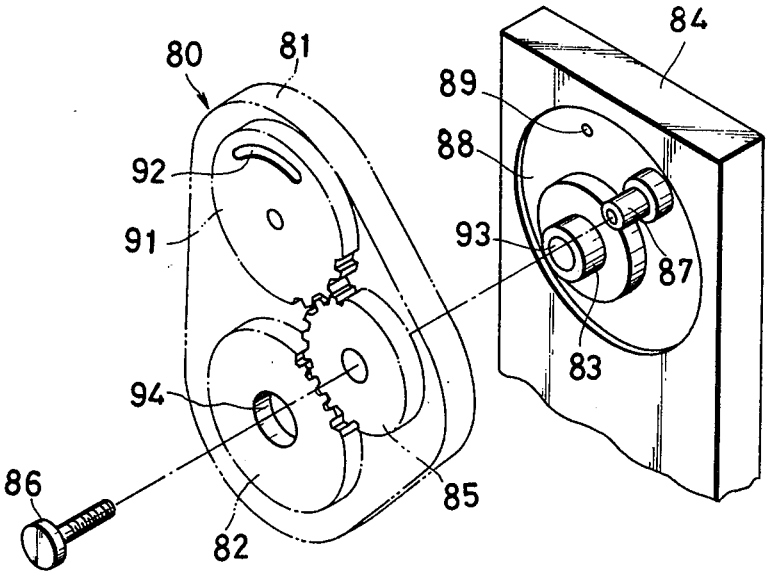
FIG. 9 is an exploded perspective view of a tension equalizer according to another embodiment.
Figure 10:
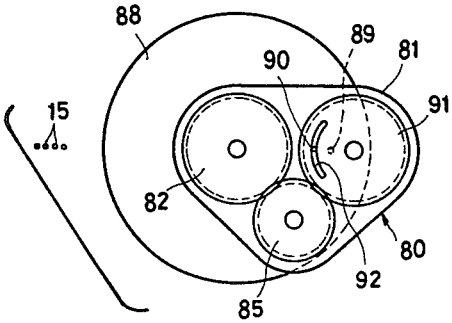
FIGS. 10 through 13 are schematic front elevational views of the tension equalizer of FIG. 9, illustrating successive relative positions of a monofilament outlet hole and a guide disk in the tension equalizer.
Figure 11:
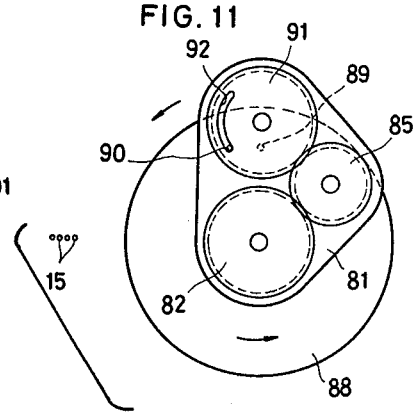
Figure 12:
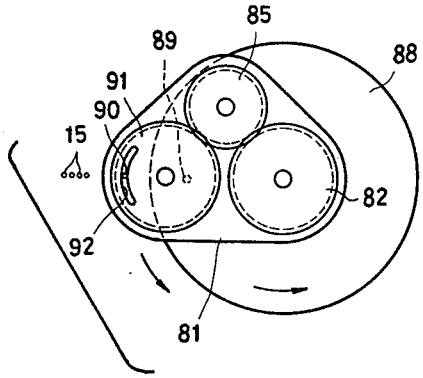
Figure 13:
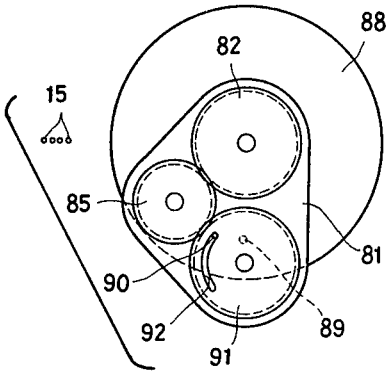

FIG. 9 shows another embodiment of a monofilament tension equalizer 80 comprising a casing or plate 81 rotatably supported on a floating bushing 83 held stationarily relatively to a housing 84 of a coiling rotor assembly (not shown) and a gear 82 disposed in the casing 81 and fixed to the floating bushing 83. An intermediate gear 85 is disposed in the casing 81 and is held in driven mesh with the gear 82. The intermediate gear 85 is rotatably mounted by a screw 86 on a shaft 87 fixed to a wheel 88 rotatably supported around the floating bushing 83 and within the housing 84. The wheel 88 has an outlet hole 89 through which a monofilament 90 (FIGS. 10 through 13) is drawn out.

A guide 91 having gear teeth is rotatably mounted in the casing 81 and is held in driven mesh with the intermediate gear 85, the guide 91 having an arcuate guide slot 92 for the passage of the monofilament therethrough. A core thread (not shown) is discharged through an axial hole 93 in the bushing 83 and an axial hole 94 in the gear 82.

The length of a portion of the monofilament 90 extending between the outlet hole 89 and the mandrel needle portion is substantially constant, and hence the tension of that portion of the monofilament 90 is substantially equalized at all times while revolving in a substantially conical orbital path around the mandrel, because of changing relative positions between the outlet hole 89 and the arcuate guide slot 92 on revolving movement of the guide 91 as illustrated in FIG. 10 through FIG. 13.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An apparatus for manufacturing a slide fastener stringer including a woven stringer tape and a coiled coupling element woven into the stringer tape along a longitudinal edge thereof, said apparatus comprising:

(a) means for weaving the stringer tape of warp and weft threads;

(b) a mandrel for extending at an angle to the warp threads;

(c) means for winding a monofilament around said mandrel to form the coiled coupling element, which is then woven into the stringer tape by the weft thread; and (d) means responsive to the operation of said winding means for substantially equalizing the tension of a portion of the monofilament revolving in a substantially conical orbital path around said mandrel.

2. An apparatus according to claim 1, said winding means comprising a housing and a wheel rotatably mounted in said housing and having a first guide for guiding the monofilament to revolve in a first circular path, said equalizing means comprising a plate operatively connected in driven relation with said wheel for rotation therewith and having a second guide for guiding the monofilament in a second circular path that is eccentric with respect to said first circular path.

3. An apparatus according to claim 2, said winding means further comprising a floating bushing held stationarily with respect to said housing and around which said wheel is rotatable, said equalizing means further comprising a guide disk fixed to said floating bushing in eccentric relation therewith and having a peripheral circular guide groove, said plate comprising a ring rotatably disposed in said pheripheral circular guide groove.

4. An apparatus according to claim 3, said equalizing means further comprising an arm fixed to said wheel and having a radial guide slot, said ring having a pin slidably received in said guide slot.

5. An apparatus according to claim 3, said mandrel being supported by said guide disk.

6. An apparatus according to claim 3, said second guide comprising an arcuate slot in said ring, for the passage of the monofilament therethrough.

7. An apparatus according to claim 2, said winding means further comprising a floating bushing held stationarily with respect to said housing and around which said wheel is rotatable, said equalizing means further comprising a first gear concentrically fixed to said floating bushing, a second gear rotatably mounted on said wheel and held in driven mesh with said first gear, said plate comprising a third gear in driven mesh with said second gear.

8. An apparatus according to claim 7, said second guide comprising an arcuate slot in said third gear, for the passage of the monofilament therethrough.

9. An apparatus for manufacturing a slide fastener stringer including a woven stringer tape and a coiled coupling element woven into the stringer tape along a longitudinal edge thereof, said apparatus comprising:

(a) means for weaving the stringer tape of warp and weft threads;

(b) a mandrel for extending at an angle to the warp threads, said mandrel having a portion to be located adjacent to the fell of the stringer tape being woven;

(c) a rotor assembly for winding a monofilament around said portion of said mandrel to form the coiled coupling element, which is then woven into the stringer tape by the weft threads, said rotor assembly comprising a housing for being disposed alongside of the warp threads, a wheel rotatably mounted in said housing and having means for guiding the monofilament to revolve in a circular path, and a floating bushing around which said wheel is rotatable; and (d) means responsive to the rotation of said wheel for guiding the monofilament to revolve in a substantially conical orbital path which is eccentric with respect to said circular path and located closer to the warp threads than said housing is, by which the length of the monofilament between said first-mentioned guide means and said portion of said mandrel is substantially constant at all times, whereby the monofilament is kept under substantially uniform tension while revolving in said substantially conical orbital path.

10. An apparatus according to claim 9, said last-mentioned guiding means comprising a circular plate lying substantially parallel to said wheel and operatively connected therewith for corotation, said circular plate having an arcuate slot for the passage of the monofilament therethrough.

* * * * *